US009746808B2

(12) United States Patent
Eiji et al.

(10) Patent No.: US 9,746,808 B2
(45) Date of Patent: Aug. 29, 2017

(54) IMAGE FORMING APPARATUS

(71) Applicant: SAMSUNG ELECTRONICS CO., LTD., Suwon-si, Gyeonggi-do (KR)

(72) Inventors: Aoki Eiji, Suwon-si (KR); Jin Soo Lee, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/240,492

(22) Filed: Aug. 18, 2016

(65) Prior Publication Data

US 2017/0052495 A1 Feb. 23, 2017

(30) Foreign Application Priority Data

Aug. 19, 2015 (KR) ..... 10-2015-0116724

(51) Int. Cl.

| | |
|---|---|
| ***B65H 3/06*** | (2006.01) |
| ***G03G 15/00*** | (2006.01) |
| ***B65H 1/04*** | (2006.01) |
| ***B65H 1/12*** | (2006.01) |
| ***B65H 5/06*** | (2006.01) |

(52) U.S. Cl.

CPC ..... *G03G 15/6511* (2013.01); *B65H 1/04* (2013.01); *B65H 1/12* (2013.01); *B65H 3/0669* (2013.01); *B65H 3/0684* (2013.01); *B65H 5/062* (2013.01); *B65H 2403/72* (2013.01); *B65H 2801/06* (2013.01); *G03G 2215/00396* (2013.01)

(58) Field of Classification Search

CPC ... B65H 3/0684; B65H 3/0696; B65H 3/0669
See application file for complete search history.

(56) References Cited

U.S. PATENT DOCUMENTS

| | | | | |
|---|---|---|---|---|
| 7,963,519 | B2 * | 6/2011 | Bokelman | B65H 3/0684 271/117 |
| 2016/0187831 | A1 * | 6/2016 | Kitano | B65H 1/04 271/110 |

FOREIGN PATENT DOCUMENTS

| | | | |
|---|---|---|---|
| JP | 03147635 | A * | 6/1991 |
| JP | 2003201031 | A * | 7/2003 |

* cited by examiner

*Primary Examiner* — Luis A Gonzalez
(74) *Attorney, Agent, or Firm* — Staas & Halsey LLP

(57) ABSTRACT

An image forming apparatus which is able to stably perform paper feeding without double feeding the printing medium, and is also able to prevent a quality of the printing medium from being damaged is provided. The image forming apparatus includes a pick-up roller configured to pick up the printing medium, and a driving source configured to transmit a driving force to the pick-up roller, wherein the pick-up roller is provided to be raised and then to be returned to its original location when picking up the printing medium.

10 Claims, 27 Drawing Sheets

IMAGE FORMING APPARATUS

CROSS-REFERENCE TO RELATED APPLICATIONS

This application claims the priority benefit of Korean Patent Application No. 10-2015-0116724, filed on Aug. 19, 2015 in the Korean Intellectual Property Office, the disclosure of which is incorporated herein by reference.

BACKGROUND

1. Field

Embodiments of the present invention relate to an image forming apparatus which performs a stable paper feeding operation.

2. Description of the Related Art

An image forming apparatus is an apparatus for printing an image on a printing medium, and includes printers, copiers, facsimiles and all-in-devices in which functions thereof are integrated.

An image forming apparatus adopting an electrophotography method scans light on a photoreceptor charged with a predetermined potential, forms an electrostatic latent image on a surface of the photoreceptor, and then supplies a toner to the electrostatic latent image to form a visible image. The visible image formed on the photoreceptor is directly transferred to a printing medium or is transferred to the printing medium via an intermediate transfer body, and the visible image transferred to the printing medium is fixed to the printing medium while passing through a fixing unit.

The image forming apparatus may include a paper pick-up unit for picking up paper loaded in a cassette or a tray one sheet at a time, and a paper feeder for conveying the picked-up paper to a paper conveying route provided inside the image forming apparatus. Two or more sheets of paper may sometimes be picked-up at one time due to a frictional force of the paper or the like and be conveyed to the paper conveying route by the paper pick-up unit to then be conveyed to an inside of the paper conveying route. In the image forming apparatus, a jam due to double feeding the paper may occur, and various other problems may also occur.

Recently, a retarding pick-up structure, in which a torque limiter and a retard roller connected to the torque limiter to be rotated in a normal or reverse direction according to the torque limiter are used, is provided to prevent a double feed of paper. The torque limiter has a predetermined critical torque value, is rotated in the normal direction when a paper conveying frictional force is greater than the critical torque value, and is rotated in the reverse direction when the paper conveying frictional force is less than the critical torque value. The retard roller is installed at a lower side of the paper conveying route and prevents a double feed of paper.

SUMMARY

Additional aspects and/or advantages will be set forth in part in the description which follows and, in part, will be apparent from the description, or may be learned by practice of the invention.

Therefore, it is an aspect of the present invention to provide an image forming apparatus which prevents a double feed of paper and also prevents damage to a printing medium.

Additional aspects of the invention will be set forth in part in the description which follows and, in part, will be obvious from the description, or may be learned by practice of the invention.

In accordance with an aspect of the present invention, an image forming apparatus includes a cassette configured to store a printing medium, a pick-up roller configured to pick up the printing medium stored in the cassette, a feed roller located in front of the pick-up roller and configured to convey the printing medium picked up by the pick-up roller, a first shaft connected to a driving source and at which the feed roller is installed, a second shaft connected to the first shaft to receive a driving force and at which the pick-up roller is installed, and a swing member at which the first shaft and second shaft are installed and which is provided to be rotated about the first shaft.

A third shaft may be further provided at the swing member, and the third shaft may be connected to the first shaft to receive the driving force.

A first gear may be provided at the first shaft, and a second gear engaged with the first gear may be provided at the third shaft.

The second gear may revolve on the first gear such that one side of the swing member may be rotated about the first shaft.

According to an embodiment, when one side of the swing member is rotated about the first shaft in a counterclockwise direction, the pick-up roller may be raised, and when one side of the swing member is rotated about the first shaft in a clockwise direction, the pick-up roller may be lowered.

A feed clutch may be provided so as to selectively transmit the driving force to the second shaft.

According to an embodiment, when the feed clutch is in an ON state, the driving force may be transmitted to the second shaft, and the printing medium may be picked up by the pick-up roller.

A rod clutch may be provided so as to selectively transmit the driving force to the third shaft.

According to an embodiment, when the rod clutch is in an ON state, the driving force may be transmitted to the third shaft and one side of the swing member may be provided to be rotatable about the first shaft.

The image forming apparatus may further include an elastic member which presses the swing member so that the pick-up roller presses the printing medium.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
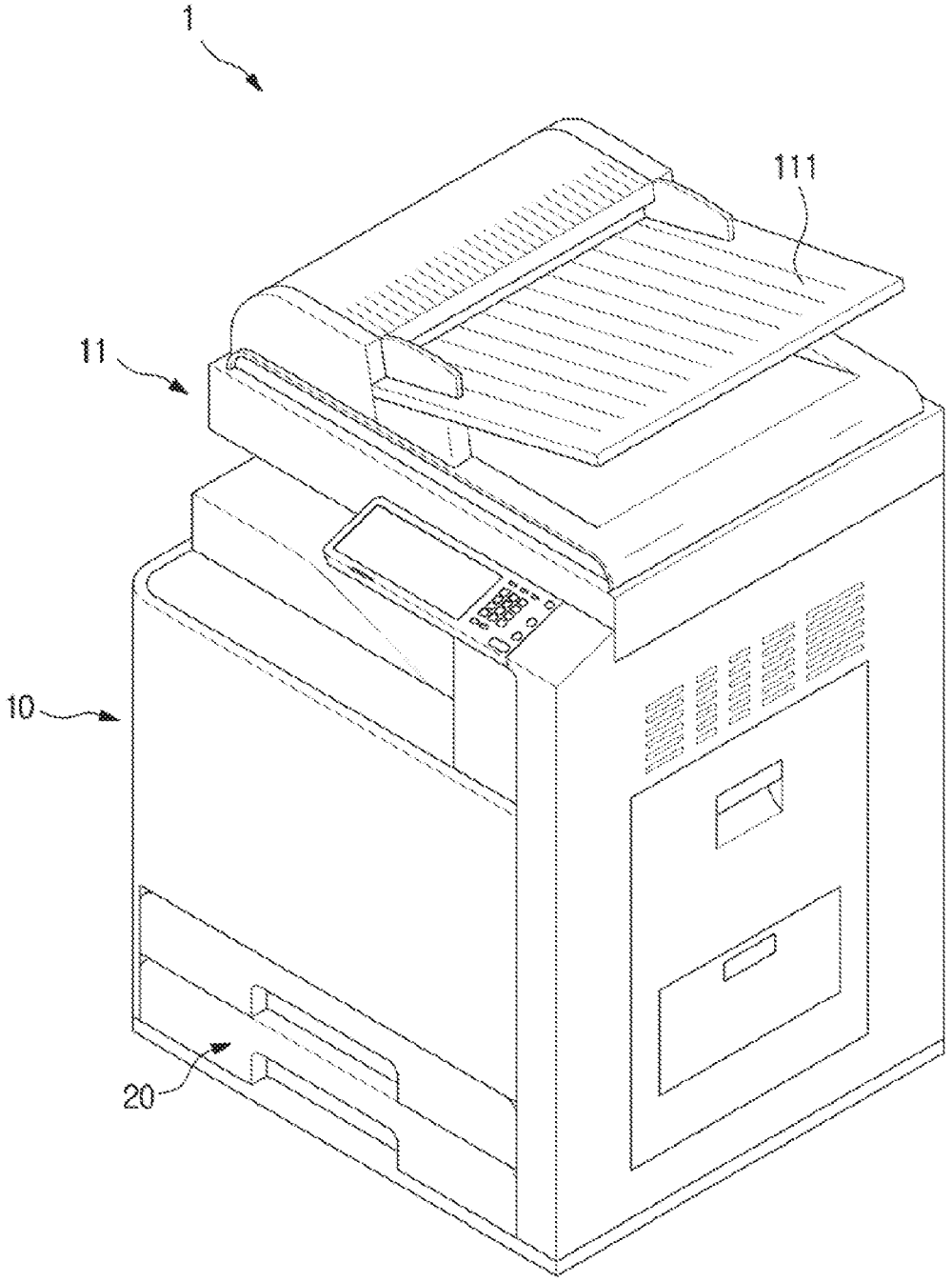
FIG. 1 is a perspective view of an image forming apparatus according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Figure 2:
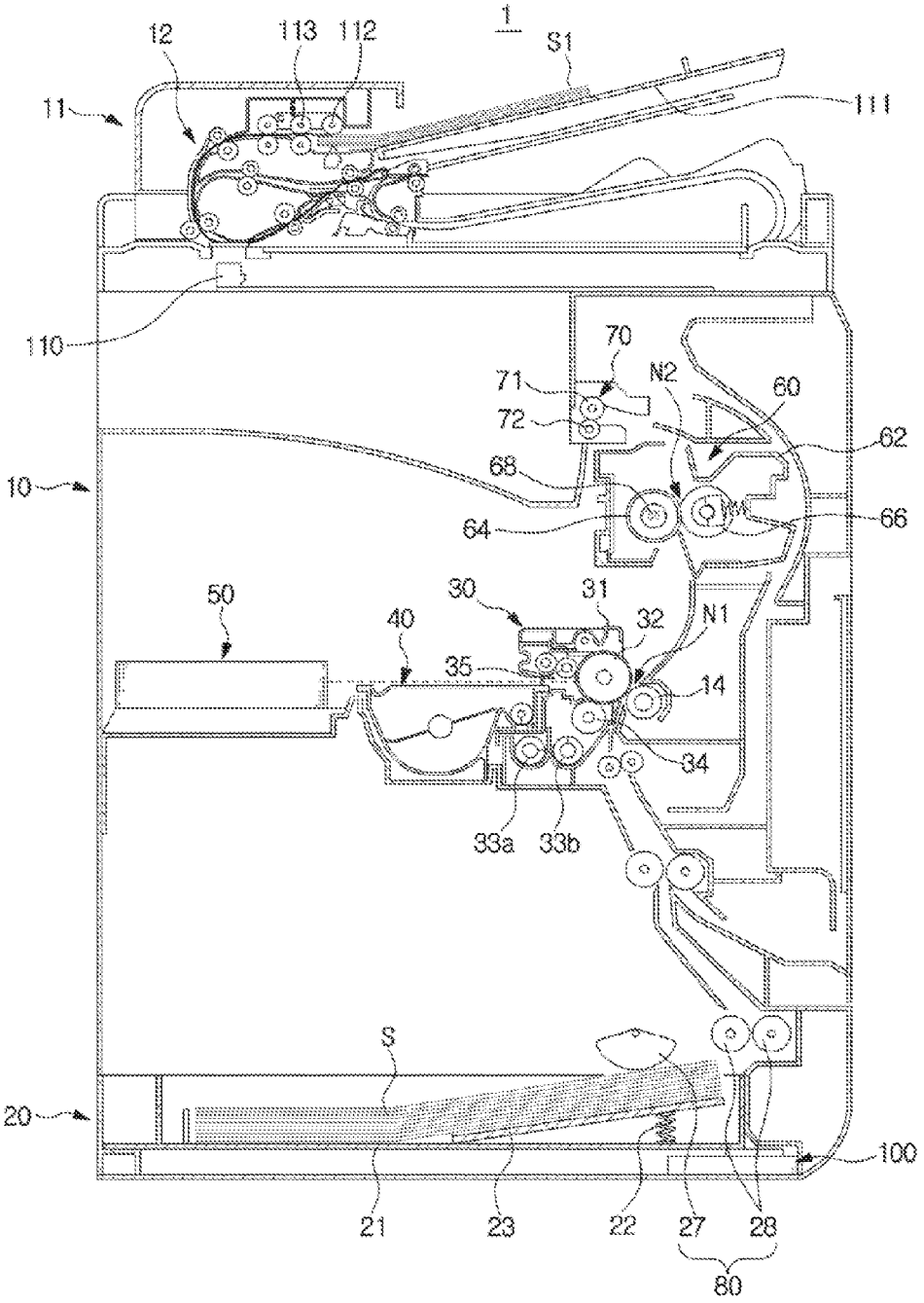
FIG. 2 is a view schematically illustrating a configuration of the image forming apparatus according to an embodiment.

FIG. 1 is a perspective view of an image forming apparatus according to an embodiment, and FIG. 2 is a view schematically illustrating a configuration of the image forming apparatus according to an embodiment.

As illustrated in FIGS. 1 and 2, an image forming apparatus 1 includes a main body 10, a paper feeder 20 for storing and feeding a printing medium S, a developing unit 30 for forming an image on the printing medium S which is supplied by the paper feeder 20, a toner unit 40 for supplying toner to the developing unit 30, an optical scanner 50 for forming an electrostatic latent image on a photoreceptor 32 of the developing unit 30, a fixing unit 60 for fixing a toner image transferred to the printing medium S on the printing medium S, and a discharging unit 70 for discharging the printing medium S, on which image forming is completed, to an outside of the main body 10.

The paper feeder 20 is configured to store and feed the printing medium S. The paper feeder 20 may be provided at a lower portion of the main body 10 to supply the printing medium S toward the developing unit 30.

The paper feeder 20 may include a cassette 21 storing the printing medium S and coupled to the main body 10 to be opened and closed, and a conveying member 80 configured to pick up the printing medium S stored in the cassette 21 one sheet at a time and to convey the picked-up printing medium S toward the developing unit 30.

A knock-up plate 23 may be provided in the cassette 21 with one end rotatably coupled thereto and the other end supported by a pressing spring 22 to guide the loaded printing medium S toward the conveying member 80.

The conveying member 80 may include a pick-up roller 27 for picking up the printing medium S loaded in the knock-up plate 23 one sheet at a time, and a feed roller 28 for conveying the printing medium S picked up by the pick-up roller 27 toward the developing unit 30.

The developing unit 30 includes a housing 31 forming an exterior thereof, the photoreceptor 32 rotatably coupled inside the housing 31 to form the electrostatic latent image, agitating screws 33*a* and 33*b* for agitating the toner supplied from the toner unit 40, a developing roller 34 for supplying the toner agitated by the agitating screws 33*a* and 33*b* to the photoreceptor 32, and a charging member 35 for charging the photoreceptor 32.

The toner supplied from the toner unit 40 may be introduced into the housing 31, and agitated and conveyed by the agitating screws 33*a* and 33*b* toward one side of the housing 31, and the agitated and conveyed toner is supplied to the photoreceptor 32 by the developing roller 34 to form a visible image.

The photoreceptor 32 may be in contact with a transfer roller 14, and forms a transfer nip N1 so that the toner supplied to the photoreceptor 32 to form the visible image is transferred to the printing medium S. The transfer roller 14 may be rotatably disposed inside the main body 10.

The toner unit 40 may be coupled to the developing unit 30. The toner unit 40 is configured to accommodate and store the toner for forming an image on the printing medium S, and to supply the toner to the developing unit 30 when an image forming operation is performed.

The optical scanner 50 scans light including image information on the photoreceptor 32 to form the electrostatic latent image on the photoreceptor 32.

The fixing unit 60 includes a housing 62 and a heating member 64 and a pressing member 66 which are rotatably disposed inside the housing 62.

The printing medium S to which a toner image is transferred passes between the heating member 64 and the pressing member 66, and at this time, the toner image may be fixed to the printing medium S by heat and pressure.

The heating member 64 may be engaged and rotated with the pressing member 66, forms a fixing nip N2 with the pressing member 66, is heated by a heat source 68, and transfers heat to the printing medium S passing through the fixing nip N2. The heating member 64 may be configured with a heating roller which receives power from a driving source (not shown) to be rotated. The heat source 68 for applying the heat to the printing medium S to which the toner is transferred may be disposed inside the heating member 64. A halogen lamp may be used as the heat source 68, and the heat source 68 may also be variously configured with a heating wire, an induction heater, or the like.

The pressing member 66 may be disposed to be in contact with an outer circumferential surface of the heating member 64 and form the fixing nip N2 between the heating member 64 and the pressing member 66. The heating member 64 may be configured with a pressing roller which receives power from a driving source (not shown) to be rotated.

The discharging unit 70 includes a first discharge roller 71 and a second discharge roller 72 which are engaged with each other, and discharges the printing medium S which passed through the fixing unit 60 to the outside of the main body 10.

An image scanning unit 11 for scanning a document S1 may be located at an upper portion of the housing 10. The image scanning unit 11 includes a document supply tray 111 on which the document S1 to be scanned is loaded, a pick-up roller 112 for picking up the document S1 loaded on the document supply tray 111 and loading the document S1 into a conveying route 12, and a feed roller 113 for conveying the picked-up document. The document S1 conveyed by the feed roller 113 may be scanned by a scanner module 110, and then may be guided to a discharging portion (not shown) located at a lower side of the document supply tray 111.

The printing medium S may be loaded in the cassette 21 provided inside the housing 10, and picked up and conveyed one sheet at a time by the pick-up roller 27. The document S1 loaded on the document supply tray 111 provided at a side of the image scanning unit 11 may be picked up and conveyed one sheet at a time by the pick-up roller 112. The printing medium S loaded in the cassette 21 and the document S1 loaded on the document supply tray 111 are picked up and supplied one sheet at a time by the pick-up rollers 27 and 112, and a double feed may occur by the pick-up rollers 27 and 112 applying a pressure to the printing medium S or the document S1 or a friction force between the pick-up rollers 27 and 112 and the printing medium S or the document S1.

A structure for preventing a double feed of the printing medium S or the document S1 may be provided at a side of the paper feeder 20 or the image scanning unit 11.

An exemplary paper feeder 20 which prevents a double feed of the printing medium S is described. A double-feed preventing structure provided at a side of the cassette 21 may also be similarly applied to a side of the pick-up roller 112 located at the side of the image scanning unit 11.

Figure 3:
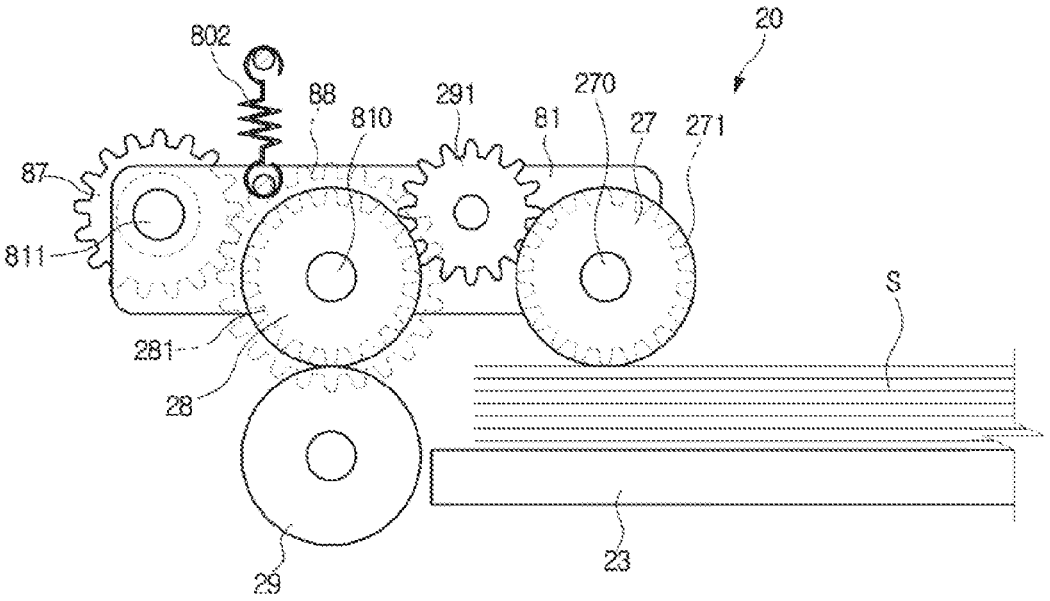
FIG. 3 is a side view illustrating a shape of a paper feeder according to an embodiment.
Figure 4:
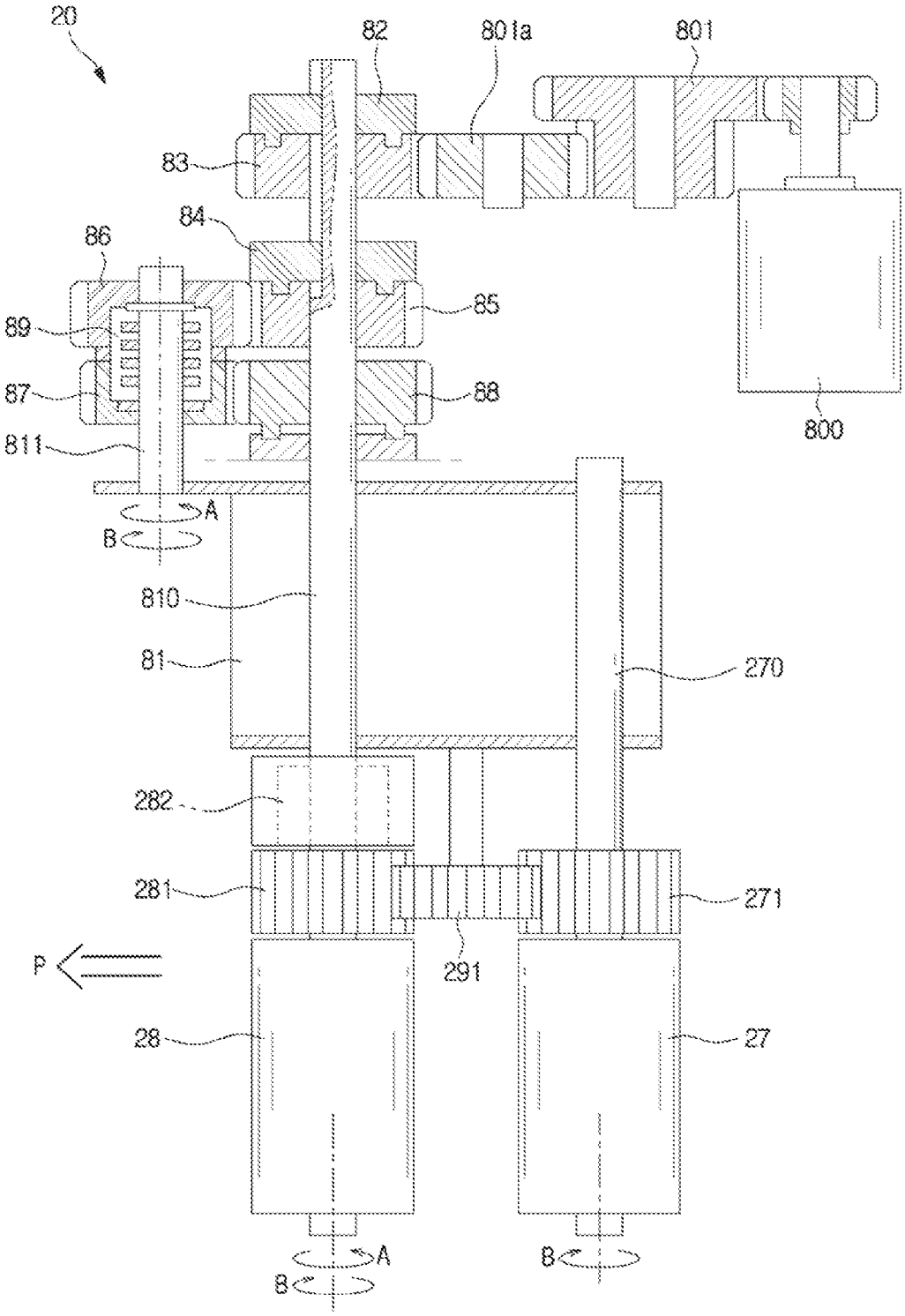
FIG. 4 is a view illustrating the shape of the paper feeder according to an embodiment when viewed from above.

FIG. 3 is a side view illustrating a shape of the paper feeder according to an embodiment, and FIG. 4 is a view illustrating the shape of the paper feeder according to an embodiment viewed from above.

Referring to FIGS. 3 and 4, the paper feeder 20 according to an embodiment may include the pick-up roller 27 for picking up the printing medium S one sheet at a time, the feed roller 28 for conveying the printing medium S picked up by the pick-up roller 27 toward the developing unit 30 (referring to FIG. 2), and a driving source 800 for transmitting a driving force to the pick-up roller 27 and the feed roller 28. The driving force of the driving source 800 may be transmitted to the pick-up roller 27 and the feed roller 28 through a driving force transmitting unit 801. The driving force transmitting unit 801 may be realized as various structures such as a gear connection type and a pulley and belt type. An exemplary structure in which the driving force transmitting unit 801 is a gear connection type is described.

The feed roller 28 may be installed at a first shaft 810 that is rotated by receiving the driving force from the driving source 800. The first shaft 810 may receive the driving force from the driving source 800 through a gear connection to be rotated.

The pick-up roller 27 may be located to be spaced apart from the feed roller 28. The pick-up roller 27 may be installed at a second shaft 270 spaced apart from the first shaft 810 by a predetermined gap. The pick-up roller 27 may be rotated by being connected to a side of the feed roller 28 and receiving the driving force.

The first shaft 810 may have a first gear 281, and the second shaft 270 may have a second gear 271. The first gear 281 and the second gear 271 may be engaged with a third gear 291. When the first shaft 810 is rotated by receiving the driving force, the driving force may be transmitted to the second gear 271 through the first gear 281 and the third gear 291. When the driving force is transmitted to the second gear 271, the second shaft 270 is rotated, and the pick-up roller 27 installed at the second shaft 270 may be rotated with the second shaft 270.

A one-way clutch 282 may be installed at the first shaft 810. Assuming that a rotating direction when the pick-up roller 27 picks up the printing medium S is defined as rotation in a clockwise direction B, the pick-up roller 27 may be rotated in the clockwise direction B when the first gear 281 is rotated in the clockwise direction B.

The one-way clutch 282 may enable the first gear 281 to be rotated with the first shaft 810 in one direction only when the first shaft 810 is rotated in the one direction. When the first shaft 810 is rotated in the clockwise direction B by the one-way clutch 282, a rotating force is not transmitted to the first gear 281. Therefore, the pick-up roller 27 may be provided to be rotated to pick up the printing medium S and to convey the printing medium S toward the feed roller 28. At this time, a conveying direction of the printing medium S may be referred to as P.

The first shaft 810 and the second shaft 270 may be rotatably installed at a swing member 81. A third shaft 811 may be installed at one side of the swing member 81. The swing member 81 may be provided to be moved with the third shaft 811. The third shaft 811 may be connected to the first shaft 810 to receive the driving force, and may revolve on an eighth gear 88 installed at the first shaft 810 which will be described later. For example, the third shaft 811 may be gear-connected to the first shaft 810. A connection method between the third shaft 811 and the first shaft 810 is not limited to a gear connection method.

Based on the first shaft 810, the third shaft 811 may be provided at the one side of the swing member 81, and the second shaft 270 may be provided at the other side thereof. When the third shaft 811 revolves on the eighth gear 88 in the clockwise direction B, the other side of the swing member 81 is lowered, and when the third shaft 811 revolves in a counterclockwise direction A, the other side of the swing member 81 is raised.

When the other side of the swing member 81 is raised, the pick-up roller 27 installed at the other side of the swing member 81 may also be raised. When the pick-up roller 27 is raised, it may be spaced apart from the printing medium S, or a force which presses the printing medium S when the printing medium S is picked up may be reduced.

After the printing medium S is picked up, the third shaft 811 may revolve in the clockwise direction B, the other side of the swing member 81 is lowered, and the pick-up roller 27 may be returned to its original position. A printing medium picking-up operation according to an operation of the swing member 81 will be described later.

The printing medium S is loaded on the knock-up plate 23 supported by the pressing spring 22. Since the knock-up plate 23 is elastically supported by the pressing spring 22, as the printing medium S loaded on the knock-up plate 23 is consumed, the knock-up plate 23 is raised and a printing medium St located at an uppermost portion may be located at a location at which the pick-up roller 27 may pick it up.

An elastic member 802 may be installed at the swing member 81. The elastic member 802 may provide an elastic force to the swing member 81 so that the pick-up roller 27 approaches the printing medium S. Due to the elastic force of the elastic member 802 and the elastic force of the pressing spring 22 which supports the knock-up plate 23, the pick-up roller 27 may pick up the printing medium S one sheet at a time by pressing the printing medium S with an appropriate pressure.

The first shaft 810 may be connected to the driving source 800 by the driving force transmitting unit 801. The driving force transmitting unit 801 may be connected to the first shaft 810 by a gear connection. A fourth gear 83 engaged with a gear portion 801*a* provided at the driving force transmitting unit 801 may be provided at the first shaft 810.

A feed clutch 82 may be provided at the first shaft 810. The feed clutch 82 enables the driving force transmitted to the fourth gear 83 to be selectively transmitted to the first shaft 810.

When the feed clutch 82 is in an ON state, the driving force of the driving source 800 may be transmitted to the first shaft 810 through the driving force transmitting unit 801 and the fourth gear 83. When the first shaft 810 is rotated in the clockwise direction B by the driving force, the driving force is transmitted toward the second shaft 270 through the first gear 281, the third gear 291, and the second gear 271 so that the pick-up roller 27 may be rotated in the clockwise direction B.

When the feed clutch 82 in an OFF state, the driving force of the driving source 800 is not transmitted to the fourth gear 83. Therefore, when the feed clutch 82 in the OFF state, the first shaft 810 is not rotated, the driving force is not transmitted to the pick-up roller 27, and thus the pick-up roller 27 is not rotated.

The driving force transmitted to the first shaft 810 may be transmitted to the third shaft 811 through a gear connection. A fifth gear 85 may be provided at the first shaft 810, and a sixth gear 86 engaged with the fifth gear 85 may be provided at the third shaft 811. When the first shaft 810 is rotated, the driving force may be transmitted through the fifth gear 85 and the sixth gear 86.

A seventh gear 87 may be further provided at the third shaft 811, and an eighth gear 88 engaged with the seventh gear 87 may be further provided at the first shaft 810. The eighth gear 88 may be provided to not move even when the first shaft 810 is rotated. When the first shaft 810 is rotated, a rotating force thereof may be transmitted to the seventh gear 87 through the fifth gear 85 and the sixth gear 86. The seventh gear 87 may revolve on the eighth gear 88 by receiving the rotating force. When the seventh gear 87 revolves on the eighth gear 88, the swing member 81 installed at the third shaft 811 may be moved with the third shaft 811.

For example, when the first shaft 810 is rotated in the clockwise direction B, the third shaft 811 may revolve on the eighth gear 88 in the counterclockwise direction A. When the third shaft 811 revolves in the counterclockwise direction A, the one side of the swing member 81 is raised, and the other side thereof is lowered. When the other side of the swing member 81 is lowered, the pick-up roller 27 may approach the printing medium S by being lowered.

Conversely, when the first shaft 810 is rotated in the counterclockwise direction A, the third shaft 811 may revolve in the clockwise direction B. When the third shaft 811 revolves in the clockwise direction B, the other side of the swing member 81 is raised and the pick-up roller 27 may be spaced apart from the printing medium S or a force applied by the pick-up roller 27 to the printing medium S may be reduced.

A rod clutch 84 may be provided at the first shaft 810. The driving force of the first shaft 810 may be selectively transmitted to the third shaft 811 by the rod clutch 84.

When the rod clutch 84 is in an ON state, the driving force of the driving source 800 may be transmitted to the third shaft 811 through the fifth gear 85 of the first shaft 810 and the sixth gear 86. When the rod clutch 84 is in an OFF state, the driving force of the first shaft 810 is not transmitted to the third shaft 811 even when the first shaft 810 is rotated. Therefore, the third shaft 811 is not rotated, and the swing member 81 and the pick-up roller 27 are not moved.

A torque limiter 89 may be provided at the third shaft 811. The torque limiter 89 may serve as a stopper. When a magnitude of the driving force input to the seventh gear 87 is a predetermined value or more, the torque limiter 89 may block the driving force from being transmitted to the third shaft 811.

A gear ratio among the fifth gear 85, the sixth gear 86, the seventh gear 87, and the eighth gear 88 may be appropriately set so that the seventh gear 87 revolves on the eighth gear 88 with a proper force and a proper speed according to rotation of the first shaft 810. For example, the sixth gear 86 may be provided to have a greater dimension than that of the fifth gear 85, the seventh gear 87 may be provided to have a smaller dimension than that of the sixth gear 86, and the eighth gear 88 may be provided to have a greater dimension than that of the seventh gear 87.

Figure 5:
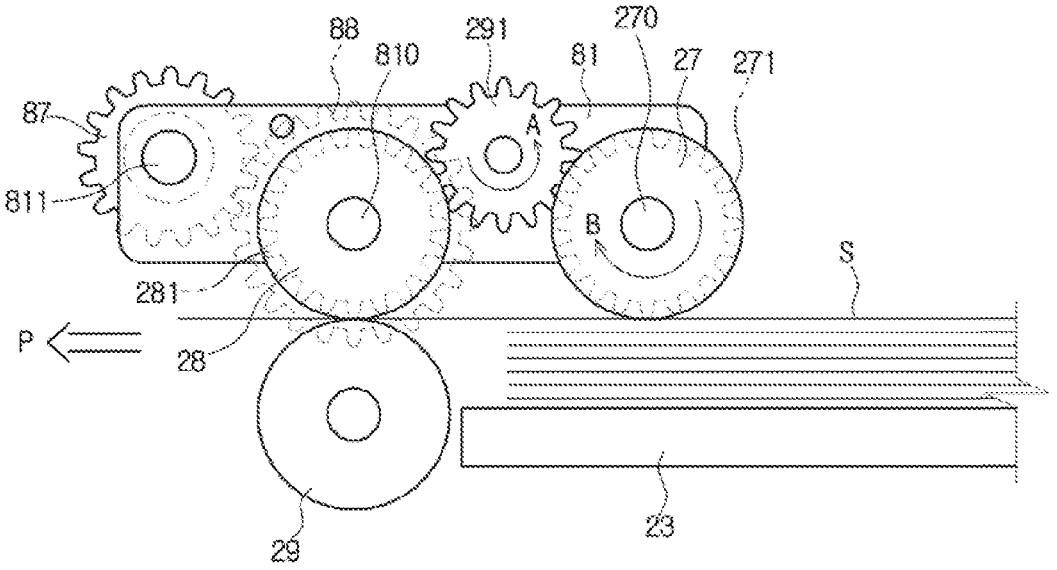
FIG. 5 is a view illustrating a partial shape of the paper feeder according to an embodiment.
Figure 6:
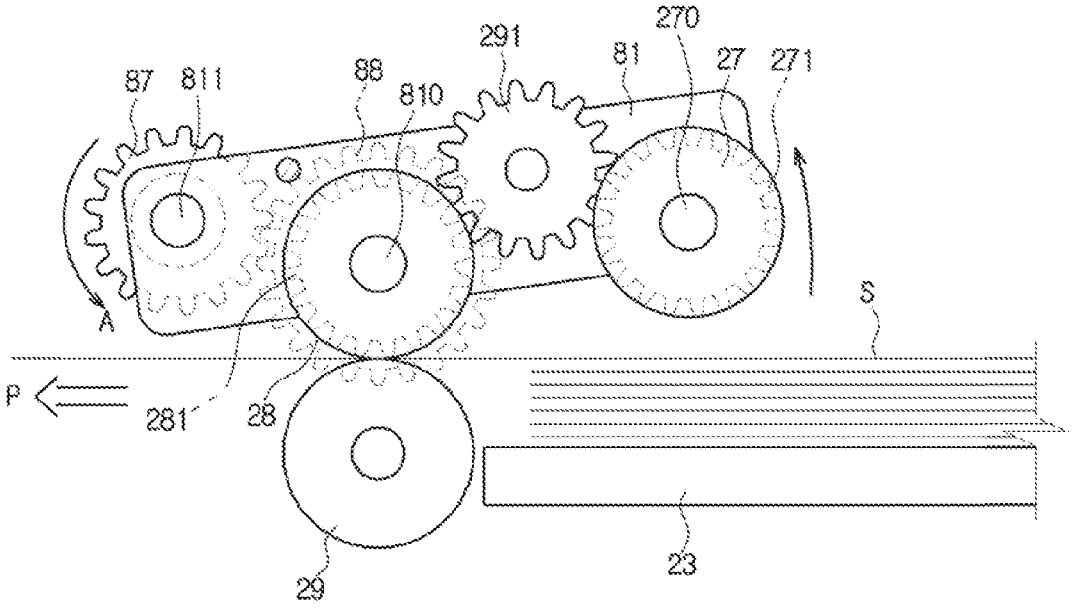
FIG. 6 is a view illustrating an operating state of the paper feeder according to an embodiment.

FIG. 5 is a view illustrating a partial shape of the paper feeder according to an embodiment, and FIG. 6 is a view illustrating an operating state of the paper feeder according to an embodiment.

Referring to FIGS. 5 and 6, in a preparation stage before the printing medium picking-up operation, the pick-up roller 27 according to an embodiment may be in contact with the printing medium S. When a command for the printing medium picking-up operation is generated by a controller (not shown), the pick-up roller 27 may pick up the printing medium S one sheet at a time by being rotated in the clockwise direction B by a driving force transmitted from the driving source 800. At this point, when the feed clutch 82 is turned on, the driving force of the driving source 800 may be transmitted through the driving force transmitting unit 801, the first shaft 810, the first gear 281, the third gear 291, and the second gear 271.

When the friction force between the pick-up roller 27 and the printing medium S is appropriate, the printing medium S may be picked up one sheet at a time by the pick-up roller 27. Assuming the friction force between the pick-up roller 27 and the printing medium S when the printing medium S may be picked up one sheet at a time by the pick-up roller 27 as a reference value, a double feed of the printing medium S may occur when the friction force between the pick-up roller 27 and the printing medium S is greater than the reference value.

In a case of a special printing medium S having a special coating layer or a concavo-convex portion formed on a surface thereof, the printing medium S may be damaged by a pressing force applied by the pick-up roller 27 to the printing medium S.

According to an embodiment of the present invention, when the printing medium S is picked up, the pick-up roller 27 may be raised for a predetermined time and may be spaced apart from the printing medium S, or the pressing force applied by the pick-up roller 27 to the printing medium S may be reduced. The force of the driving source 800 may drive the seventh gear 87 may revolve along the eighth gear 88 in the counterclockwise direction A. When the seventh gear 87 revolves along the eighth gear 88 in the counterclockwise direction A, the other side of the swing member 81 at which the pick-up roller 27 is located may be raised. When the other side of the swing member 81 is raised, the pick-up roller 27 may be spaced apart from the printing medium S, or the pressing force applied by the pick-up roller 27 to the printing medium S may be reduced.

By raising the pick-up roller 27 for the predetermined time, a double feed of the printing medium S or damage to the surface of the special printing medium S may be prevented.

When the seventh gear 87 revolves along the eighth gear 88 in the clockwise direction B by the driving force of the driving source 800, the other side of the swing member 81 is lowered, and the pick-up roller 27 may be returned to its original position by approaching the printing medium S. When the predetermined time passes, the pick-up roller 27 may be returned to its original location at which the printing medium S may be picked up.

Figure 7:
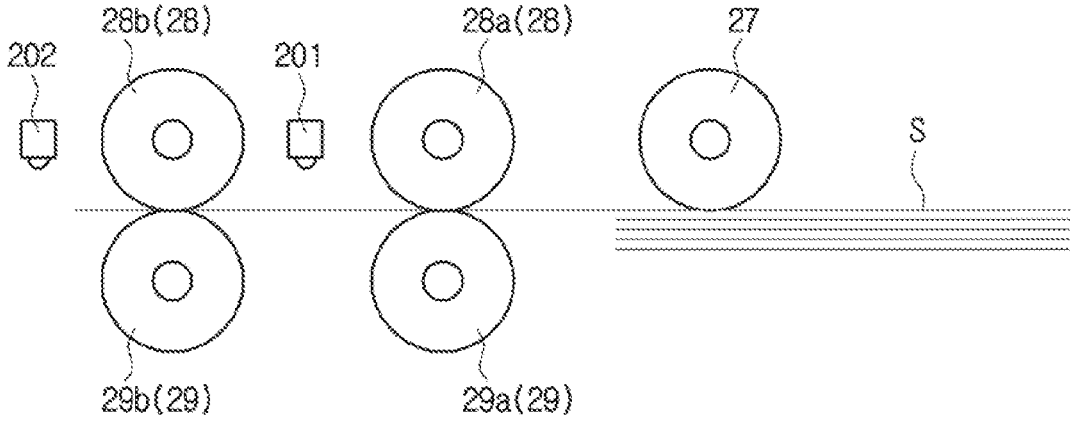
FIG. 7 is a view illustrating a state in which a sensor is provided at the paper feeder according to an embodiment.
Figure 8:
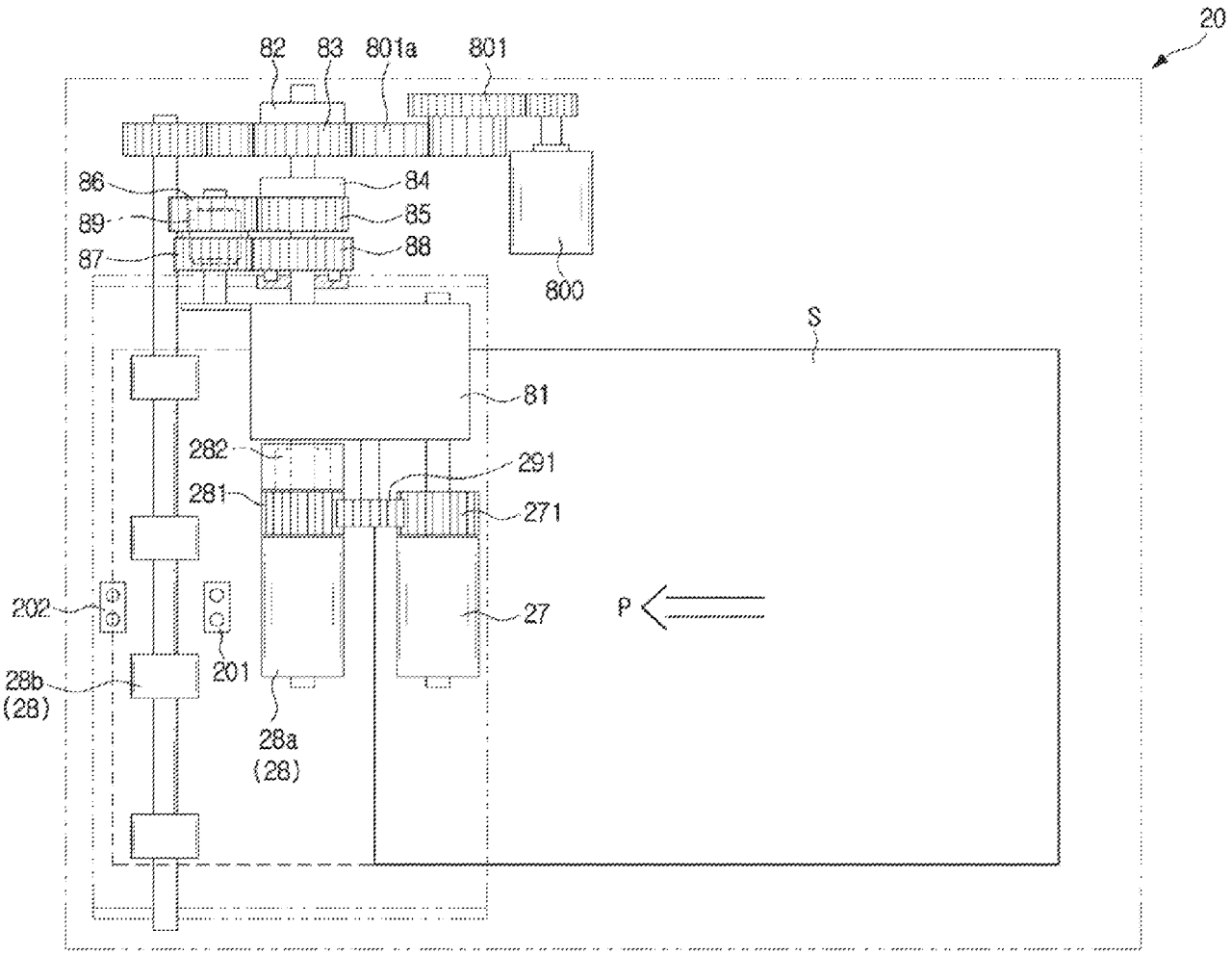
FIG. 8 is a schematic view illustrating a configuration of the paper feeder including a sensor.

FIG. 7 is a view illustrating a state in which a sensor is provided at the paper feeder according to an embodiment, and FIG. 8 is a schematic view illustrating a configuration of the paper feeder having the sensor.

Referring to FIGS. 7 and 8, sensors 201 and 202 may be provided at the paper feeder 20 according to an embodiment and may sense the printing medium S. The sensors 201 and 202 may sense the printing medium S, and may transmit a sensed result to the controller. The controller may use the sensed result to raise or lower the pick-up roller 27.

Assuming that a direction in which the printing medium S is picked up and moved by the pick-up roller 27 is toward a front direction, the feed roller 28 is located in front of the pick-up roller 27. The feed roller 28 may include a first feed roller 28*a* and a second feed roller 28*b* that is spaced apart from the first feed roller 28*a* and located in front of the first feed roller 28*a*.

A retard roller 29 may be provided under the feed roller 28. The retard roller 29 may be provided to be rotated in a direction opposite to a rotating direction of the feed roller 28, or may be provided as an idle roller which is not rotated. A double feed of the printing medium S passing through the feed roller 28 may be prevented by the retard roller 29. A first retard roller 29*a* may be provided under the first feed roller 28*a*, and a second retard roller 29*b* may be provided under the second feed roller 28*b*.

One or a plurality of the sensors 201 and 202 may be provided. For example, the sensors 201 and 202 may include a first sensor 201 and a second sensor 202. The first sensor 201 may be located between the first feed roller 28*a* and the second feed roller 28*b*. The second sensor 202 may be located in front of the second feed roller 28*b*. Locations and the number of sensors 201 and 202 are not limited to the above description.

The controller may control the pick-up roller 27 to be raised or lowered using the sensed result from the sensors 201 and 202. For example, when the printing medium S is picked up by the pick-up roller 27, moved toward the first feed roller 28*a*, and the printing medium S is sensed by the first sensor 201, the controller may control the pick-up roller 27 to be raised.

When the printing medium S is moved toward the second feed roller 28*b* by the first feed roller 28*a* and then sensed by the second sensor 202, the controller may control the pick-up roller 27 to be lowered. The pick-up roller 27 may be lowered and thus may be returned to its original location.

Figure 9:
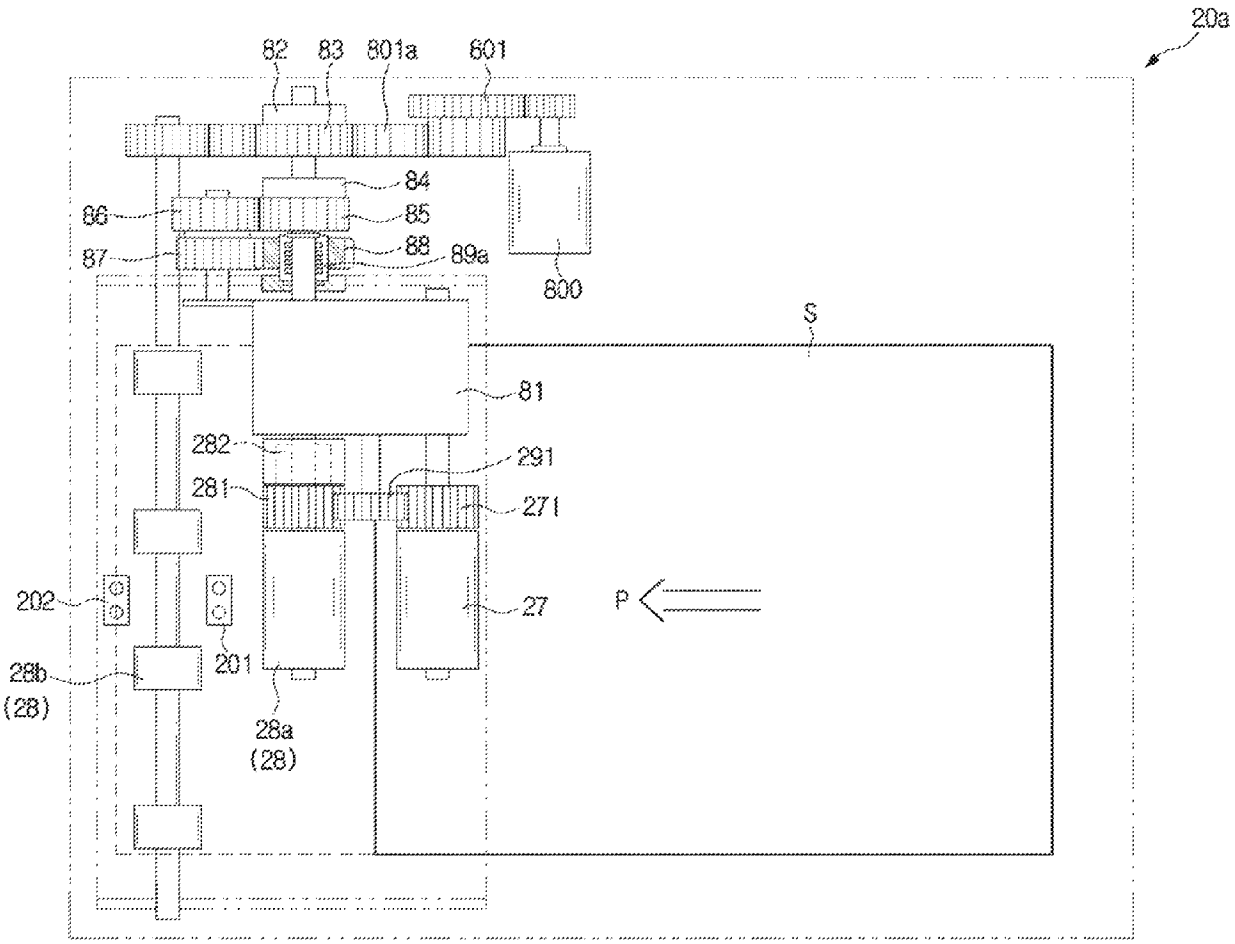
FIG. 9 is a view illustrating a paper feeder according to an embodiment.

FIG. 9 is a view illustrating a paper feeder according to an embodiment.

Referring to FIG. 9, a torque limiter 89*a* provided at a paper feeder 20*a* according to another embodiment may be installed at the first shaft 810. Similar to the torque limiter 89 according to the embodiment illustrated in FIG. 4, the torque limiter 89*a* illustrated in FIG. 9 may serve as a stopper.

The fifth gear 85 and the eighth gear 88 may be provided at the first shaft 810, and the sixth gear 86, which is engaged with the fifth gear 85, and the seventh gear 87, which is engaged with the eighth gear 88, are provided at the third shaft 811. A driving force transmitted to the first shaft 810 through the driving force transmitting unit 801 may be transmitted to the eighth gear 88 through the fifth gear 85, the sixth gear 86, and the seventh gear 87.

The torque limiter 89*a* is installed at the first shaft 810, and when the magnitude of the driving force transmitted from the seventh gear 87 to the eighth gear 88 is a predetermined value or more, the revolving of the seventh gear 87 on the eighth gear 88 may be hindered.

When the rod clutch 84 is in the ON state and the magnitude of the driving force transmitted to the seventh gear 87 is the predetermined value or less, the seventh gear 87 may revolve on the eighth gear 88 to move the swing member 81. The pick-up roller 27 may be raised or lowered according to a revolving direction of the seventh gear 87.

Figure 10:
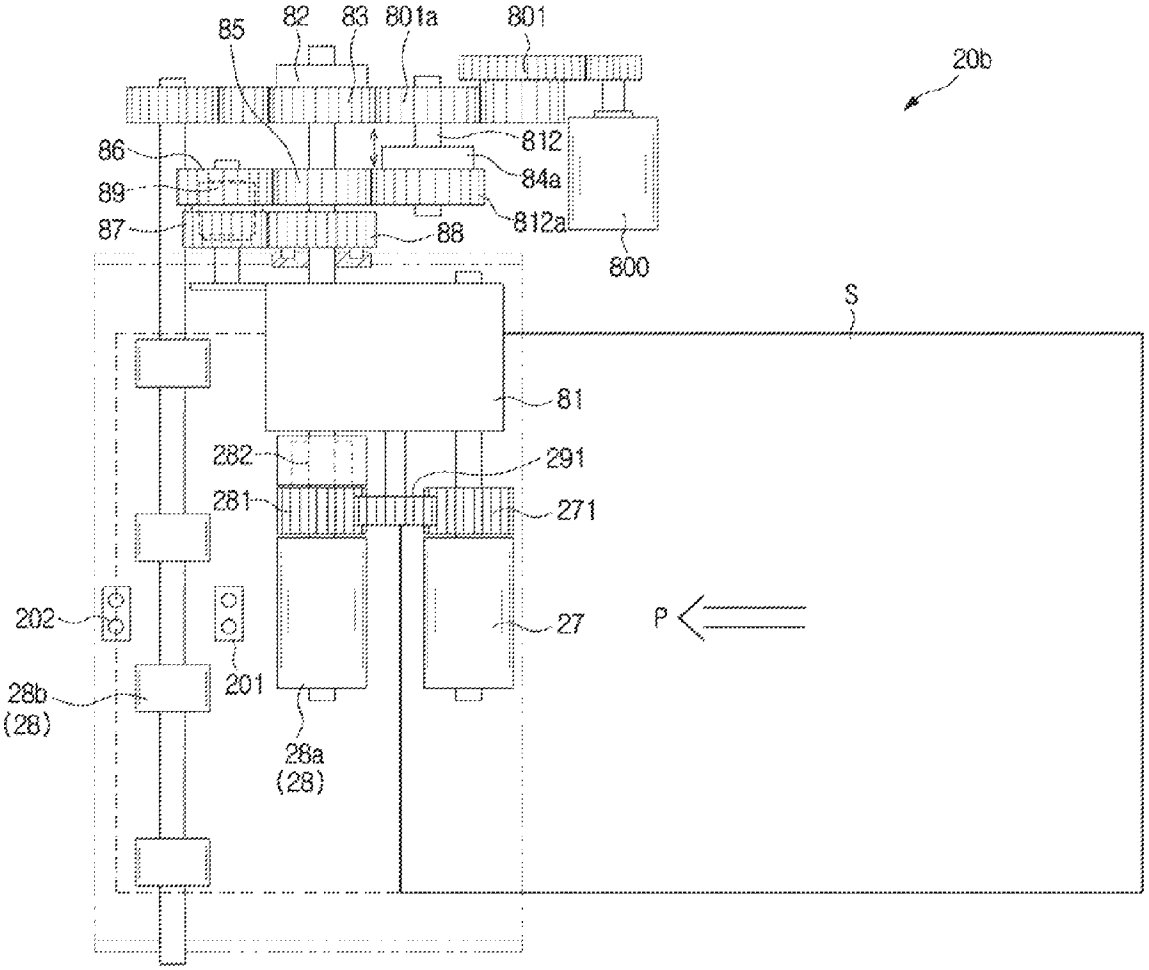
FIG. 10 is view illustrating a paper feeder according to an embodiment.

FIG. 10 is view illustrating a paper feeder according to still another embodiment.

Referring to FIG. 10, in a paper feeder 20*b* according to still another embodiment, the rod clutch 84 may not be provided at the first shaft 810. The paper feeder 20*b* may further include a fourth shaft 812 which is located to be spaced apart from the first shaft 810. A rod clutch 84*a* may be provided at the fourth shaft 812. The fourth shaft 812 may receive a driving force from the driving source 800 by being connected to the driving force transmitting unit 801.

A ninth gear 812*a* selectively engaged with the fifth gear 85 provided at the first shaft 810 may be provided at the fourth shaft 812. The ninth gear 812*a* may be provided to be moved along the fourth shaft 812.

A tenth gear 812*b* engaged with the fourth gear 83 provided at the first shaft 810 may be further provided at the fourth shaft 812. The tenth gear 812*b* may connect the fourth gear 83 with the driving force transmitting unit 801. The driving force of the driving source 800 may be transmitted to the first shaft 810 through the driving force transmitting unit 801, the tenth gear 812*b*, and the fourth gear 83. The first shaft 810 may be rotated by the driving force received through the tenth gear 812*b*. The driving force transmitted to the first shaft 810 may be transmitted to the pick-up roller 27 through the first gear 281, the third gear 291, and the second gear 271. The pick-up roller 27 receiving the driving force may be rotated and may pick up the printing medium S.

When the rod clutch 84*a* is in the ON state, the swing member 81 may be moved by receiving the driving force. When the rod clutch 84*a* is in the ON state, the ninth gear 812*a* may be engaged with the fifth gear 85. When the ninth gear 812*a* is engaged with the fifth gear 85, the driving force of the driving source 800 may be transmitted to the fifth gear 85. The driving force transmitted to the fifth gear 85 may be transmitted to the third shaft 811 through the sixth gear 86. By the driving force being transmitted to the third shaft 811, the seventh gear 87 may move the swing member 81 while being rotated about the eighth gear 88 in a clockwise direction or counterclockwise direction. Accordingly, the pick-up roller 27 may be raised or lowered.

When the rod clutch 84*a* is in the OFF state, the ninth gear 812*a* may be spaced apart from the fifth gear 85 by being moved along the fourth shaft 812. Since the ninth gear 812*a* and the fifth gear 85 are not engaged with each other, the driving force is not transmitted to the fifth gear 85 and is also not transmitted to the third shaft 811. When the rod clutch 84*a* is in the OFF state, a raising or lowering of the pick-up roller 27 is not performed.

Figure 11:
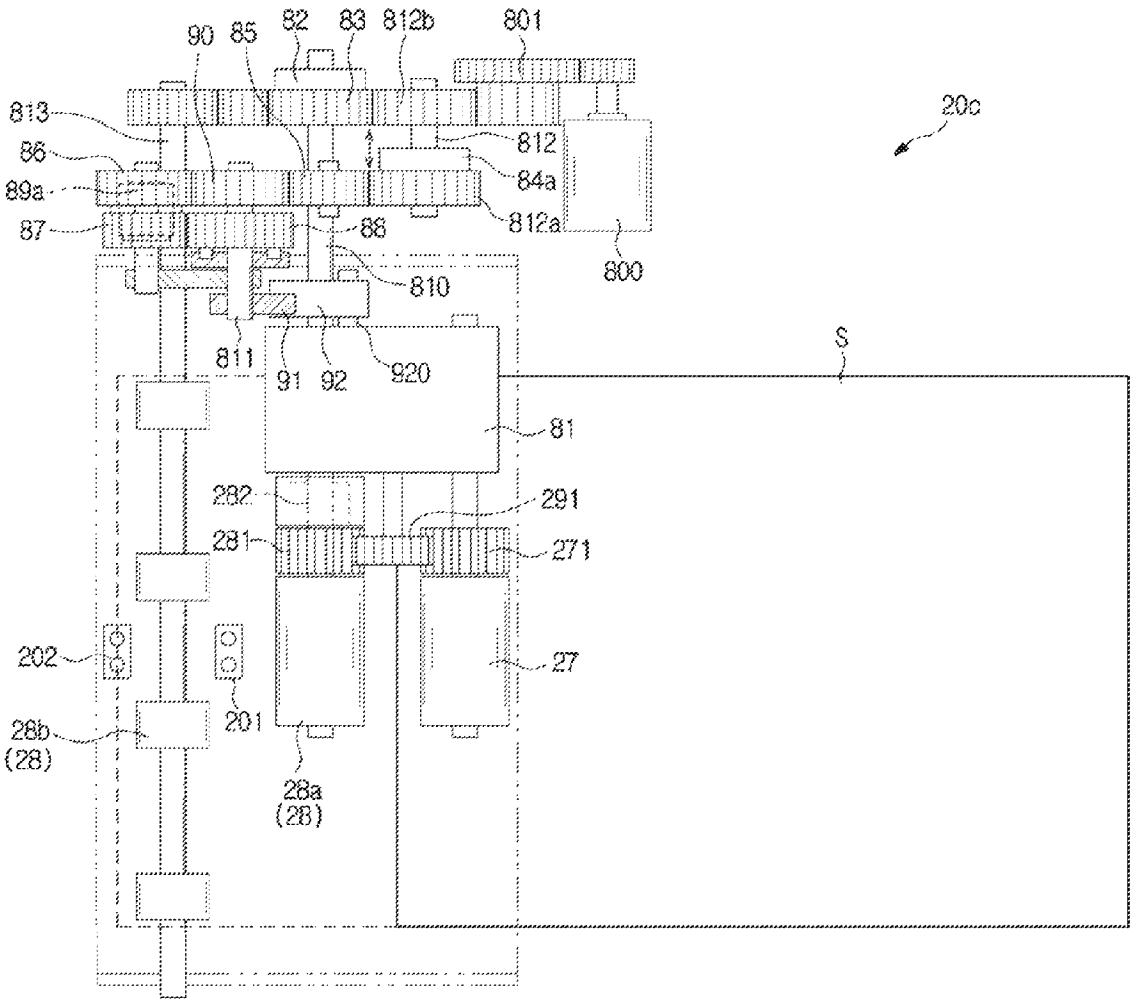
FIG. 11 is a view illustrating a paper feeder according to an embodiment.

FIG. 11 is a view illustrating a paper feeder according to yet another embodiment.

Referring to FIG. 11, in a paper feeder 20*c* according to yet another embodiment, the torque limiter 89*a* may not be provided at the third shaft 811. The paper feeder 20*c* may include a fifth shaft 813 which is located to be spaced apart from the third shaft 811. The torque limiter 89*a* may be installed at the fifth shaft 813.

The fifth shaft 813 may have the sixth gear 86 which receives a driving force and the seventh gear 87 provided to receive the driving force from the sixth gear 86 and to revolve on the eighth gear 88. The torque limiter 89*a* may be provided at the fifth shaft 813 and may serve as a stopper. When a magnitude of the driving force input to the sixth gear 86 is a predetermined value or more, the torque limiter 89*a* may enable the driving force not to be transmitted to the fifth shaft 813.

A connection gear 90 engaged with the fifth gear 85 and the sixth gear 86 may be provided at the third shaft 811. When the magnitude of the driving force input to the sixth gear 86 through the fifth gear 85 and the connection gear 90 is the predetermined value or less, the driving force may be transmitted to the eighth gear 88 through the seventh gear 87. When the driving force is transmitted to the eighth gear 88, the third shaft 811 may be rotated.

A first cam 91 may be provided at the third shaft 811. A second cam 92, which may be pressed by the first cam 91, may be provided at the swing member 81. The first cam 91 may press the second cam 92 due to a rotation of the third shaft 811, and thus the other side of the swing member 81 may be lowered or raised. Accordingly, the pick-up roller 27 located at the other side of the swing member 81 may be lowered or raised.

A location of the torque limiter, the rod clutch, or the like is not limited to the above description and the present invention may be realized in various structures.

Figure 12A:
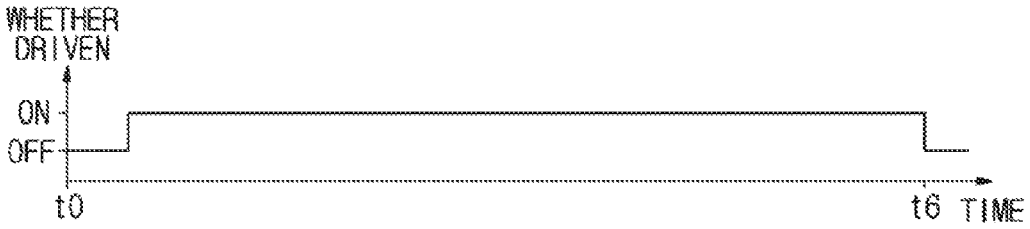
FIGS. 12A-12E are graphs illustrating exemplary operations of the paper feeder in a separating mode.
Figure 12B:
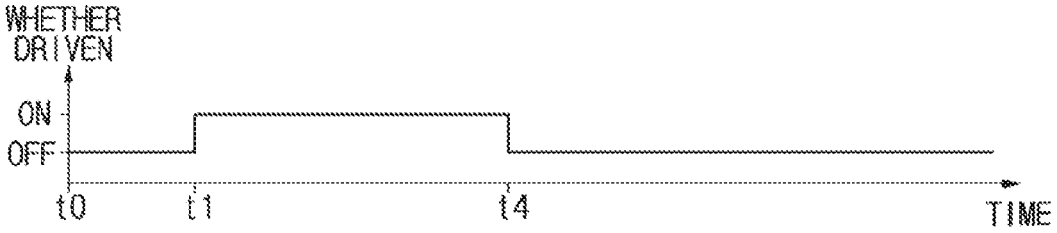
Figure 12C:
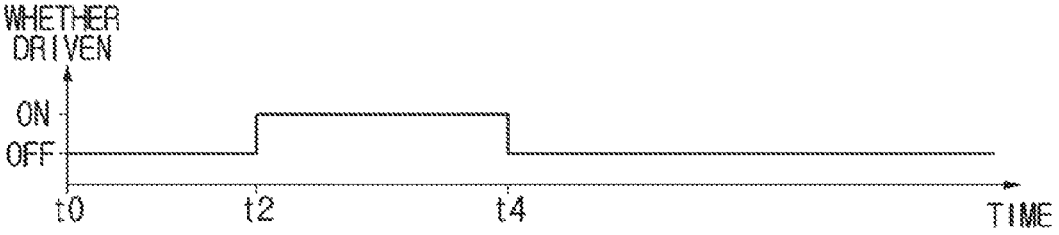
Figure 12D:
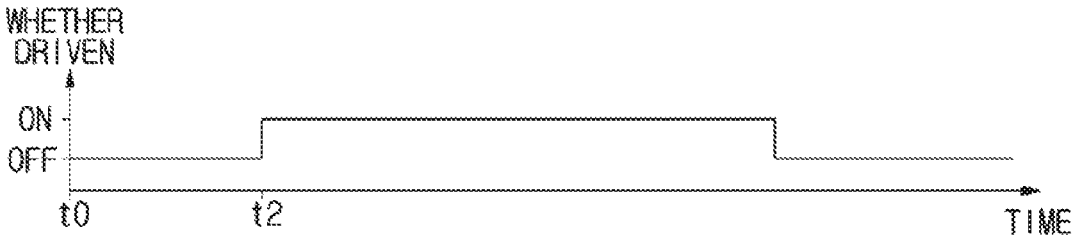
Figure 12E:
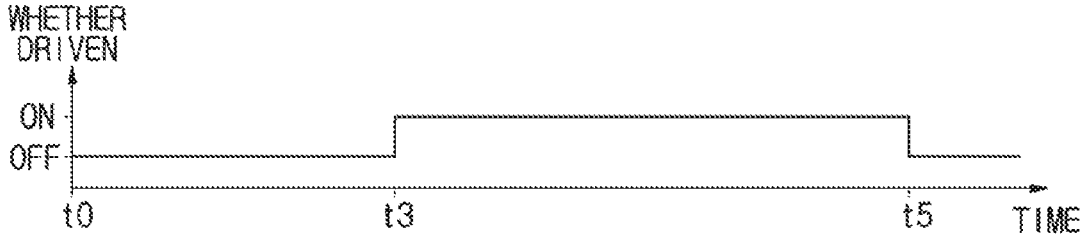
Figure 13A:
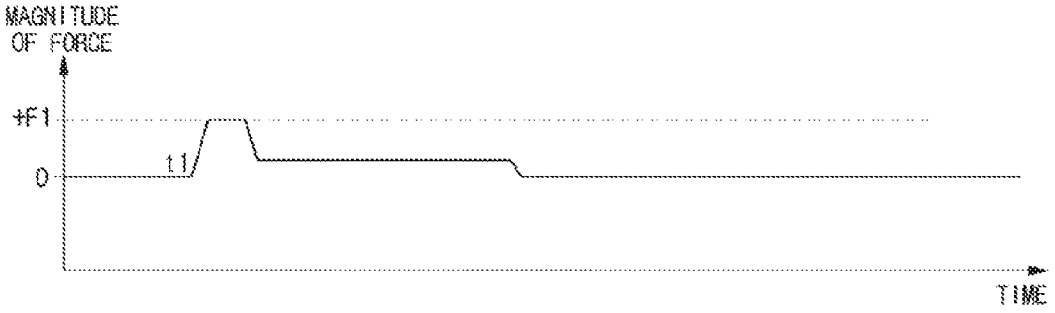
FIGS. 13A-13C are graphs illustrating exemplary operations of a pick-up roller of the paper feeder in the separating mode.

FIGS. 12A-12E are graphs illustrating operations of the paper feeder in a separating mode, and FIGS. 13A-130 are graphs illustrating operations of the pick-up roller of the paper feeder in the separating mode.

FIGS. 12A-12E and FIGS. 13A-130 are graphs of an embodiment in which the pick-up roller 27 is spaced apart from the printing medium S by the swing member 81 when the pick-up roller 27 picks up the printing medium S.

FIG. 12A is a graph illustrating an ON/OFF operation of the driving source 800 over time. FIG. 12B is a graph illustrating an ON/OFF operation of the feed clutch 82 over time. FIG. 12C is a graph illustrating an ON/OFF operation of the rod clutch 84 over time. FIG. 12D is a graph illustrating whether the printing medium S is sensed by the first sensor 201 over time. FIG. 12E is a graph illustrating whether the printing medium S is sensed by the second sensor 202 over time.

Figure 13B:
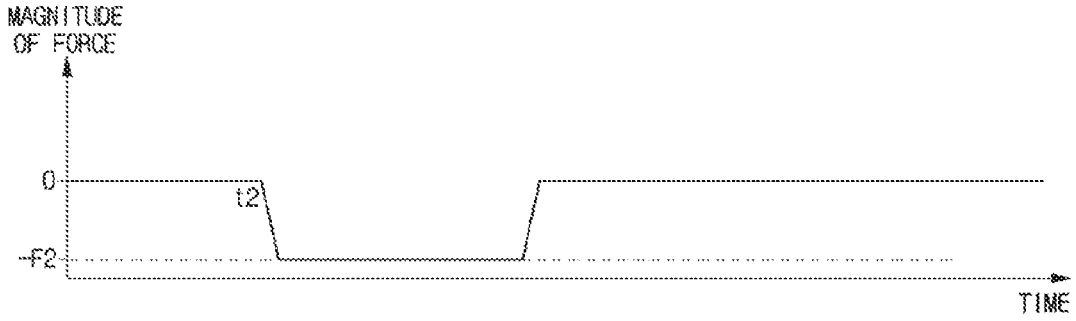
Figure 13C:
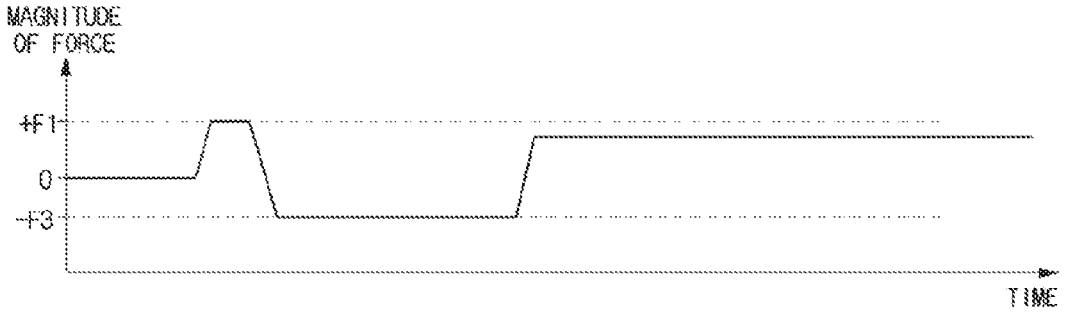

FIG. 13A is a graph illustrating a magnitude of force applied by the pick-up roller 27 to the printing medium S when the feed clutch 82 is turned on. FIG. 13B is a graph illustrating a magnitude of a force which is applied by the swing member 81 to raise the pick-up roller 27. FIG. 130 is a graph illustrating a sum of the force at the pick-up roller 27.

When the driving source 800 is turned on, a driving force may be transmitted to the first shaft 810 by the driving force transmitting unit 801. After the driving source 800 is turned on, the controller may control the feed clutch 82 to be turned on. A time point at which the feed clutch 82 is turned on may be referred to as t1. When the feed clutch 82 is turned on, the pick-up roller 27 may be rotated by the driving force transmitted to the first shaft 810. The pick-up roller 27 may pick up the printing medium S while being rotated.

At this point, a force applied by the pick-up roller 27 to the printing medium S may be +F1.

The printing medium S may be picked up by the pick-up roller 27 and then conveyed toward the first feed roller 28*a*. When the printing medium S is sensed by the first sensor 201, the controller may control the rod clutch 84 to be turned on. A time point at which the first sensor 201 starts to sense the printing medium S may be referred to as t2. The rod clutch 84 may be turned on at the same time as the printing medium S is sensed by the first sensor 201. Therefore, a time point at which the rod clutch 84 is turned on may be referred to as t2.

When the rod clutch 84 is turned on, the driving force may be transmitted by the swing member 81 and the pick-up roller 27 may be raised. At this point, a force which raises the pick-up roller 27 is −F2. In −F2, "−" indicates a force in a direction opposite to a direction of the force when the pick-up roller 27 presses the printing medium S.

When the rod clutch 84 is in the ON state, a sum of the force at the pick-up roller 27 may be −F3. −F3 is a sum of +F1 and −F2. Since the force which raises the pick-up roller 27 is greater than the force applied by the pick-up roller 27 to the printing medium S, the sum of the force at the pick-up roller 27 is −F3. Since the sum of the force at the pick-up roller 27 has a negative value, the pick-up roller 27 is in a spaced apart state from the printing medium S.

A time point at which the printing medium S is conveyed by the first feed roller 28*a* and the second feed roller 28*b* and at which the second sensor 202 starts to sense the printing medium S may be referred to as t3. After the printing medium S is sensed by the second sensor 202, the rod clutch 82 may be turned off. When the rod clutch 82 is turned off, the swing member 81 may be returned to its original location by the elastic force of the elastic member 802. The pick-up roller 27 may be lowered with the swing member 81 and may come into contact with the printing medium S. A time point at which the rod clutch 82 is turned off may be referred to as t4.

At this point, the force which raises the pick-up roller 27 may be 0, and the force applied by the pick-up roller 27 to the printing medium S may be +F1 again. The pick-up roller 27 may be spaced apart from the printing medium S by being raised for a time of t4−t1.

When the printing medium S is not sensed any more by the second sensor 202, the controller may control the driving source 800 to be turned off. A time point at which the printing medium S is finally sensed by the second sensor 202 may be referred to as t5, and a time point at which the driving source 800 is turned off may be referred to as t6.

As described above, after the printing medium S is picked up by the pick-up roller 27, the pick-up roller 27 is spaced apart from the printing medium S for a predetermined time (t4−t1) before the entire printing medium S passes through the pick-up roller 27, and thus a double feed of the printing medium S may be effectively prevented.

Figure 14A:
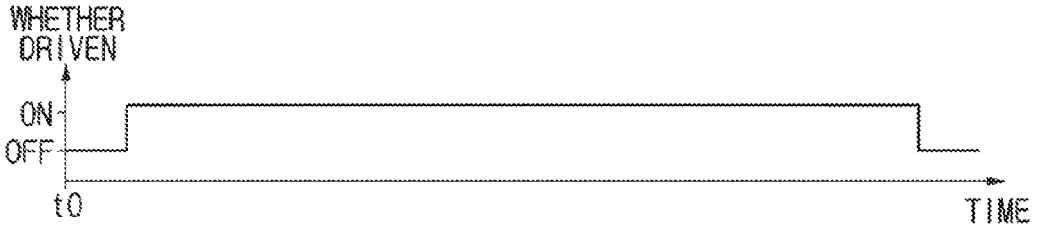
FIGS. 14A-14E are graphs illustrating exemplary operations of the paper feeder in a decompression mode.
Figure 14B:
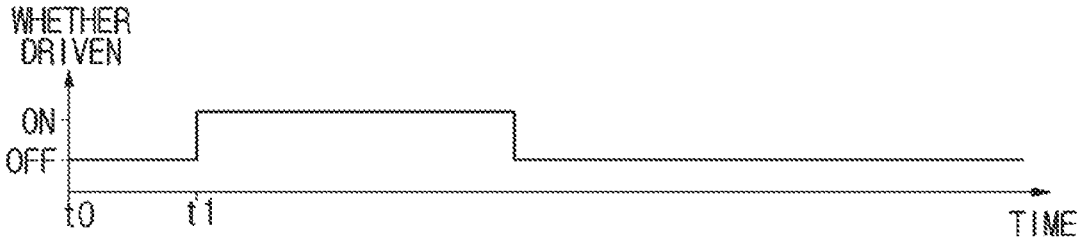
Figure 14C:
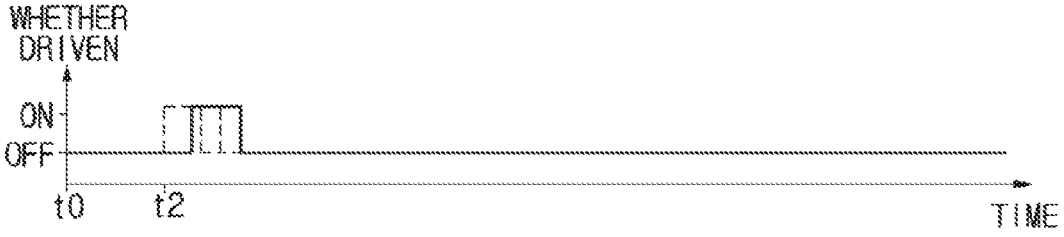
Figure 14D:
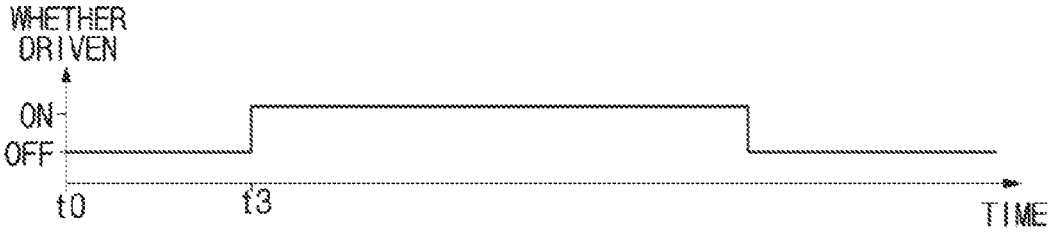
Figure 14E:
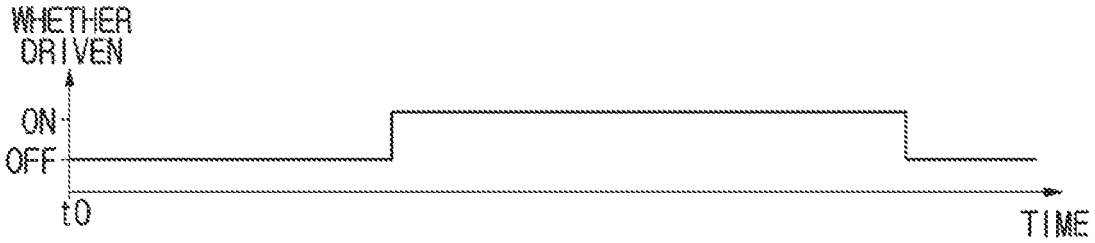
Figure 15A:
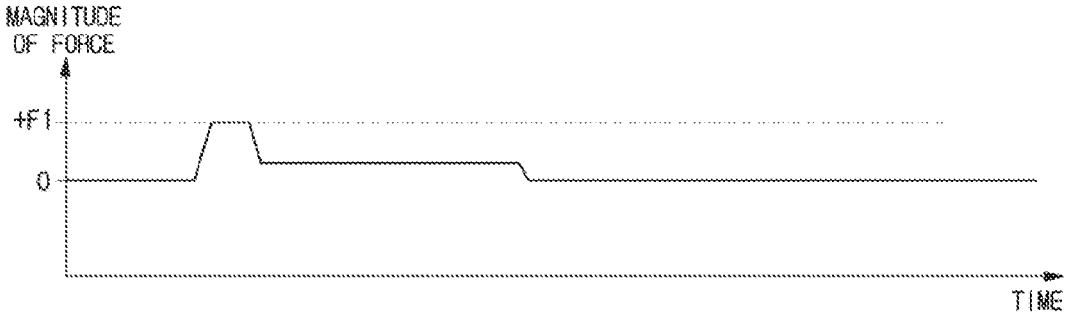
FIGS. 15A-15C are graphs illustrating exemplary operations of the pick-up roller of the paper feeder in the decompression mode.
Figure 15B:
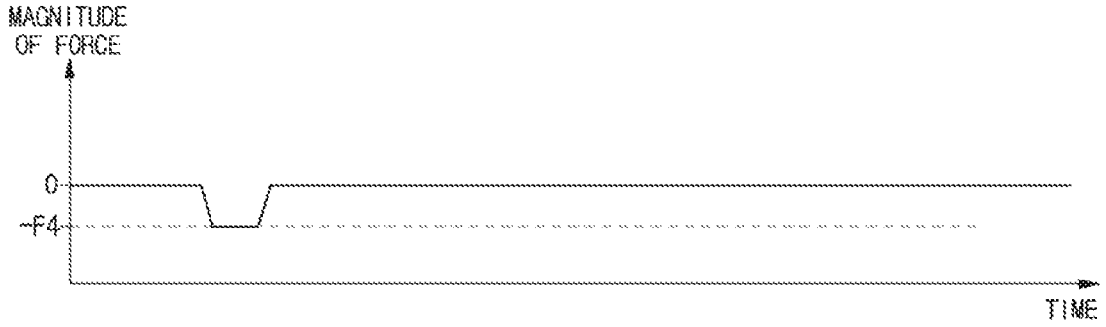
Figure 15C:
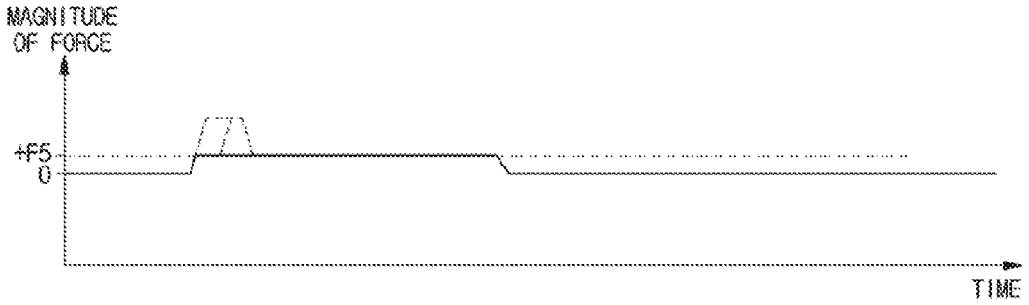

FIGS. 14A-14E are graphs illustrating operations of the paper feeder in a decompression mode, and FIGS. 15A-15C are graphs illustrating operations of the pick-up roller of the paper feeder in the decompression mode.

FIGS. 14A-14E and FIGS. 15A-15C are graphs illustrating a case in which a magnitude of the force applied by the pick-up roller 27 to the printing medium S is reduced when the pick-up roller 27 picks up the printing medium S.

FIG. 14A is a graph illustrating the ON/OFF operation of the driving source 800 over time. FIG. 14B is a graph illustrating the ON/OFF operation of the feed clutch 82 over time. FIG. 14C is a graph illustrating the ON/OFF operation of the rod clutch 84 overtime. FIG. 14D is a graph illustrating whether the printing medium S is sensed by the first sensor 201 over time. FIG. 14E is a graph illustrating whether the printing medium S is sensed by the second sensor 202 over time.

FIG. 15A is a graph illustrating the magnitude of the force applied by the pick-up roller 27 to the printing medium S when the feed clutch 82 is turned on. FIG. 15B is a graph illustrating the magnitude of the force applied by the swing member 81 to raise the pick-up roller 27. FIG. 150 is a graph illustrating the sum of the force at the pick-up roller 27.

When the driving source 800 is turned on, a driving force may be transmitted to the first shaft 810 by the driving force transmitting unit 801. After the driving source 800 is turned on, the controller may control the feed clutch 82 to be turned on. A time point at which the feed clutch 82 is turned on may be referred to as t1. When the feed clutch 82 is turned on, the printing medium S is picked up by the pick-up roller 27, and the force applied by the pick-up roller 27 to the printing medium S may be +F1.

When the feed clutch 82 is turned on, the rod clutch 84 may also be turned on. The rod clutch 84 may be turned on simultaneously with the feed clutch 82, or may be turned on before the feed clutch 82 is turned on. When the rod clutch 84 is in the ON state, the force which raises the pick-up roller 27 is −F4. F4 may have a value smaller than F1. Therefore, the sum of the force at the pick-up roller 27 may be +F5. In +F5, "+" indicates that a force that the pick-up roller 27 presses the printing medium S with has a magnitude of F5.

The printing medium S may be pressed and picked up with the magnitude of F5, which is smaller than F1, by the pick-up roller 27.

When the printing medium S is sensed by the first sensor 201, the rod clutch 84 may be turned off. A time point at which the rod clutch 84 is turned off may be referred to as t3. When the rod clutch 84 is turned off, the pick-up roller 27 may be lowered by the elastic force of the elastic member 802, and may pick up the printing medium S while pressing the printing medium S with the force of +F1.

A case in which the rod clutch 84 is turned off when the printing medium S is sensed by the first sensor 201 (t3) has been described. However, the time point at which the rod clutch 84 is turned off may be later than t3.

Accordingly, since the force applied to the printing medium S is reduced when the pick-up roller 27 picks up the printing medium S, the printing medium S may be prevented from being damaged when the special printing medium S having a coating layer or a concavo-convex portion is picked up.

The control method of the paper feeder in FIGS. 12A-12E to FIGS. 15A-15C are just examples, and the paper feeder of the present invention may be controlled in various ways.

The image forming apparatus according to an embodiment can stably supply the printing medium without double feeding the printing medium, and also can prevent the printing medium from being damaged.

Although a few embodiments of the present invention have been shown and described, it should be appreciated by those skilled in the art that changes may be made in these embodiments without departing from the principles and spirit of the invention, the scope of which is defined in the claims and their equivalents.

What is claimed is:

1. An image forming apparatus comprising:

a cassette configured to store a printing medium;

a pick-up roller configured to pick up the printing medium stored in the cassette;

a feed roller configured to convey the printing medium picked up by the pick-up roller;

a first shaft connectable to a driving source and at which the feed roller is installed;

a second shaft connectable to the first shaft and configured to receive a driving force and at which the pick-up roller is installed;

a swing member at which the first shaft and second shaft are installed and configured to be rotated about the first shaft;

a third shaft provided at the swing member, and connectable to the first shaft to receive the driving force; and a rod clutch configured to selectively transmit the driving force to the third shaft.

2. The image forming apparatus according to claim 1, further comprising:

a first gear provided at the first shaft, and a second gear engageable with the first gear provided at the third shaft.

3. The image forming apparatus according to claim 2, wherein the second gear is revolvable on the first gear such that one side of the swing member is rotated about the first shaft.

4. The image forming apparatus according to claim 1, wherein, when one side of the swing member is rotated about the first shaft in a counterclockwise direction, the pick-up roller is raised, and when one side of the swing member is rotated about the first shaft in a clockwise direction, the pick-up roller is lowered.

5. The image forming apparatus according to claim 1, wherein a feed clutch is provided so as to selectively transmit the driving force to the second shaft.

6. The image forming apparatus according to claim 5, wherein, when the feed clutch is in an ON state, the driving force is transmitted to the second shaft, and the printing medium is picked up by the pick-up roller.

7. The image forming apparatus according to claim 1, wherein, when the rod clutch is in an ON state, the driving force is transmitted to the third shaft and one side of the swing member is provided to be rotatable about the first shaft.

8. The image forming apparatus according to claim 1, further comprising an elastic member configured to press the swing member so that the pick-up roller presses the printing medium.

9. The image forming apparatus according to claim 1, wherein the feed roller is located in front of the pick-up roller.

10. A paper feeder for an image forming apparatus, the paper feeder comprising:

a pick-up roller configured to pick up a printing medium;

a feed roller configured to convey the printing medium picked up by the pick-up roller;

a first shaft connectable to a driving source and at which the feed roller is installed;

a second shaft connectable to the first shaft and configured to receive a driving force and at which the pick-up roller is installed;

a swing member at which the first shaft and second shaft are installed and configured to be rotated about the first shaft;

a third shaft provided at the swing member, and connectable to the first shaft to receive the driving force; and a rod clutch configured to selectively transmit the driving force to the third shaft.

* * * * *